US006339855B1

(12) United States Patent
Socha et al.

(10) Patent No.: US 6,339,855 B1
(45) Date of Patent: Jan. 22, 2002

(54) CRIB OR BED WITH FULLY ACCESSIBLE PATIENT SURFACE AND SIDE RAIL POSITIONING MECHANISM THEREFOR

(75) Inventors: Greg Socha, Kalamazoo, MI (US); Doug Maynard; Eric Nord, both of Jacksonville, FL (US)

(73) Assignee: Pedicraft, Inc., Jacksonville, FL (US)

( * ) Notice: Subject to any disclaimer, the term of this patent is extended or adjusted under 35 U.S.C. 154(b) by 0 days.

(21) Appl. No.: 09/406,768

(22) Filed: Sep. 28, 1999

(51) Int. Cl.[7] ..... A47D 7/02
(52) U.S. Cl. ..... 5/93.1; 5/424; 5/425
(58) Field of Search ..... 5/93.1, 100, 425, 5/424, 428, 430; 292/336.5, 348; 70/380

(56) References Cited

U.S. PATENT DOCUMENTS

| | | | | |
|---|---|---|---|---|
| 2,640,203 | A | | 6/1953 | Sheldon |
| 3,299,450 | A | | 1/1967 | Gottfried et al. |
| 3,583,006 | A | | 6/1971 | Oehms |
| D227,626 | S | | 7/1973 | Ferguson |
| 3,780,387 | A | | 12/1973 | Propst |
| D232,279 | S | | 8/1974 | White |
| 3,921,233 | A | | 11/1975 | Mann |
| 3,932,903 | A | * | 1/1976 | Adams et al. ..... 5/100 |
| 4,612,679 | A | * | 9/1986 | Mitchell ..... 5/425 |
| D289,714 | S | | 5/1987 | Toffolo |
| 4,752,977 | A | * | 6/1988 | Smith et al. ..... 5/93 R |
| D300,997 | S | | 5/1989 | Simpkins et al. |

FOREIGN PATENT DOCUMENTS

CA 1 249 702 2/1989

OTHER PUBLICATIONS

Midmark Parts Lists and Service Manual—Midmark Model 500 Pediatric Crib/Stretcher, Dec., 1990.

Hard Manufacturing Company, Inc.—Cribs & Youth Beds Sales Brochure.

Pedicraft—Cribs and Accessories Sales Brochure.

Midmark 500 Pediatric Stretcher/Crib Sales Brochure, 1993.

* cited by examiner

*Primary Examiner*—Lynne H. Browne
*Assistant Examiner*—Fredrick Conley
(74) *Attorney, Agent, or Firm*—Wenderoth, Lind & Ponack, L.L.P.

(57) ABSTRACT

A crib apparatus comprises at least one side rail connected to a frame along a bed surface for enclosing the bed surface. A positioning mechanism is provided at each of the side rails for positioning a respective side rail. Each of the positioning mechanisms includes a handle component, a rotatable lock spindle attached to a respective side rail, and a locking component slidably receiving the vertical lock spindle. The handle component is connected to the lock spindle so that it can rotate the lock spindle from a lock position to a release position in order to allow one of the lock pins to be released from the locking component. Each of the positioning mechanisms allows its respective side rail to be positioned in an uppermost position so that a top portion of the side rail is vertically higher than the bed surface, and in a lowermost position so that the top portion of the side rail is substantially at or below the bed surface. Each of the side rails is connected to the frame so that when the side rail is in the lowermost position, a plane including the bed surface is free of impediments thereby allowing unimpeded access to a patient on the bed surface.

29 Claims, 9 Drawing Sheets

PRIOR ART

CRIB OR BED WITH FULLY ACCESSIBLE PATIENT SURFACE AND SIDE RAIL POSITIONING MECHANISM THEREFOR

BACKGROUND OF THE INVENTION

The present invention relates generally to cribs or beds having side rails that can be raised and lowered. In particular, the invention relates to a crib or bed that allows full and unimpeded access to a patient on a bed surface when the side rails are in the lowermost position, and it relates to a positioning mechanism for positioning the side rails of the bed or crib.

Cribs and beds for infants or small children, which have side rails to prevent the occupant from inadvertently falling to the floor are well known. In addition, cribs or beds with moveable side rails to facilitate placing a child in the crib, removing a child from the crib, or attending to a child that is already in the crib, are also well known.

Conventionally, cribs or beds having side rails that are moveable between upper and lower positions are known to include support means to guide the moveable side rails between the upper and lower positions. One example of this type of crib has a fixed board or side rail at the head end of the crib, and a fixed board or side rail at the foot end of the crib. The fixed side rails at the ends of the crib serve as supports and guides for the moveable side rails at either side of the crib.

Another example of a type of conventional crib which includes side rails capable of moving between an upper position and a lower position is shown in FIG. 9. Instead of a fixed side rail to serve as a support and guide, this type of crib utilizes several fixed side rail support beams 100 to support and guide the moveable side rails 103 as they move between upper and lower positions relative to a bed surface 102. Each of the support beams 100 may have a track or groove in each of its sides in which the moveable side rails 103 can slide.

One major disadvantage of the conventional cribs described above is that these cribs severely limit accessibility to the child. Although the crib shown in FIG. 9 may provide more access to a child than a crib having fixed side rails or boards at the ends of the crib, the side rail support beams 100 still limit access to the child by providing an impediment to someone attending to the child. This limited access is magnified in an emergency situation when attending physicians and nurses must have instantaneous access to the child from all areas surrounding the crib, and must be able to move around the crib quickly and easily while still attending to the child. In that emergency situation, the side rail support beams 100 create impediments which cause attending physicians and nurses to waste precious moments navigating around the impediments. In addition, in that emergency situation, an attending physician or nurse should be able to raise or lower one of the side rails and place the side rail into a proper position with a single hand so that their other hand is free to perform other tasks.

Accordingly, there is a need for an improved bed or crib: which provides safety and restraint for a child in the crib; which has side rails capable of being easily moved between uppermost and lowermost positions; which includes safety features to prevent the accidental lowering of the side rails; and which provides full and unimpeded access to a child on a bed surface of the crib. In addition, there is a need for an improved positioning mechanism which enables a side rail of a crib or bed to be quickly and accurately positioned with one hand, and which does not create an impediment preventing access to a child on the bed surface of the crib.

SUMMARY OF THE INVENTION

One object of thee present invention is to provide a crib apparatus which fulfills all of the needs discussed above. The crib apparatus of the present invention comprises a frame, a bed surface supported by the frame, and at least one side rail for enclosing the bed surface and which is connected to the frame along the periphery of the bed surface so that it is moveable. A side rail positioning mechanism is provided at each of the side rails for positioning that side rail. Each of the positioning mechanisms allows its respective side rail to be positioned in an uppermost position so that the top portion of the side rail is above (with respect to a vertical direction) the bed surface. Each of the positioning mechanisms also allows its side rail to be positioned in a lowermost position so that the top portion of the side rail is substantially at or below the bed surface. When the side rails are in the lowermost position, a geometric plane that includes the bed surface is free of impediments thereby allowing unimpeded access to a patient on the bed surface by an attendant.

It is to be understood that some portions of the apparatus, such as handles or frame members, may extend slightly higher than a plane in which the bed surface lies when the side rails are in the lowermost position and still provide unimpeded access to a patient. In addition, the top portions of the side rails may extend slightly higher than the bed surface and still be substantially at the bed surface. For example, when the side rails are in the lowermost position, the top portions may extend above the bed surface a distance equal to or less than the front-to-back thickness of a typical child so as to be substantially at the bed surface without impeding access to the child.

The present invention may include a plural number of side rails which together enclose the bed surface. In that case, the positioning mechanism for each side rail can position that respective side rail independent of the position of any of the other side rails. Consequently, one side and one end may be in the lowermost position while the remaining side and the remaining end may be in the uppermost position. Alternatively, the present invention can comprise a single side rail that encloses the bed surface and is moveable between an uppermost position and a lowermost position.

Each of the side rails may be connected to the frame by bearing blocks. Therefore, each of the side rails is capable of sliding in the bearing blocks between the uppermost position and the lowermost position. In addition, each of the positioning mechanisms can be used to position its side rail in at least one intermediate position between the uppermost position and the lowermost position.

In addition to providing a crib apparatus that allows full and unimpeded access to a patient on the bed surface, another object of the invention is to provide a positioning mechanism capable of allowing the side rails of a crib to be moved and positioned without using structural supports or guides that extend above the bed surface. The positioning mechanism of the present invention comprises a handle component mounted to a side rail, and a vertical lock spindle which is rotatably attached to the same side rail and has several lock pins spaced vertically along its length. The positioning mechanism also includes a locking component for receiving the vertical lock spindle, and which is fixed to the frame. The handle component is connected to the lock spindle so that when actuated, the handle rotates the lock spindle enabling one of the lock pins to be released from the locking component.

It is important that the positioning mechanism for the side rail of a crib have a safety feature that prevents the accidental lowering of the side rail. The positioning mechanism of the present invention has this type of safety feature. The locking component includes a through-hole for receiving the lock spindle, and includes a pair of vertical grooves extending along the length of the through-hole (in a longitudinal direction of the through-hole). A catch is pivotally mounted within one of the grooves halfway through the length of the through-hole (at a longitudinal midpoint of the through-hole). The side rail can be positioned by being raised so that one of the lock pins passes through the locking component as the catch pivots upwards, and then slightly lowered so that the lock pin comes to rest on the catch within the groove since the catch cannot pivot downward from its normal, or resting, position. In order to lower the side rails, the handle component must be actuated to rotate the lock spindle and the lock pin so that the lock pin can be aligned with the other groove (the groove without the catch). In addition, the side rail must be slightly raised in order to lift the lock pin off of the catch and out of the groove. These two actions—actuating the handle component and lifting the side rail—are necessary to lower the side rail, and comprise the safety feature of the present invention which prevents the accidental lowering of the side rail.

As can be seen from the brief summary provided above, the present invention provides an improved crib apparatus which allows full and unimpeded access to a patient on the bed surface, while also providing a safety feature to prevent the accidental lowering of the side rails. In addition, the positioning mechanism for the crib apparatus of the present invention allows one handed raising and lowering of the side rail, which is very important if an attending physician or nurse must quickly raise or lower the side rail while accomplishing at least one other task simultaneously.

BRIEF DESCRIPTION OF THE DRAWINGS

Other objects and advantages of the present invention will be apparent from the following description, provided with reference to the following drawings, in which.

DETAILED DESCRIPTION OF THE INVENTION

Figure 1A:
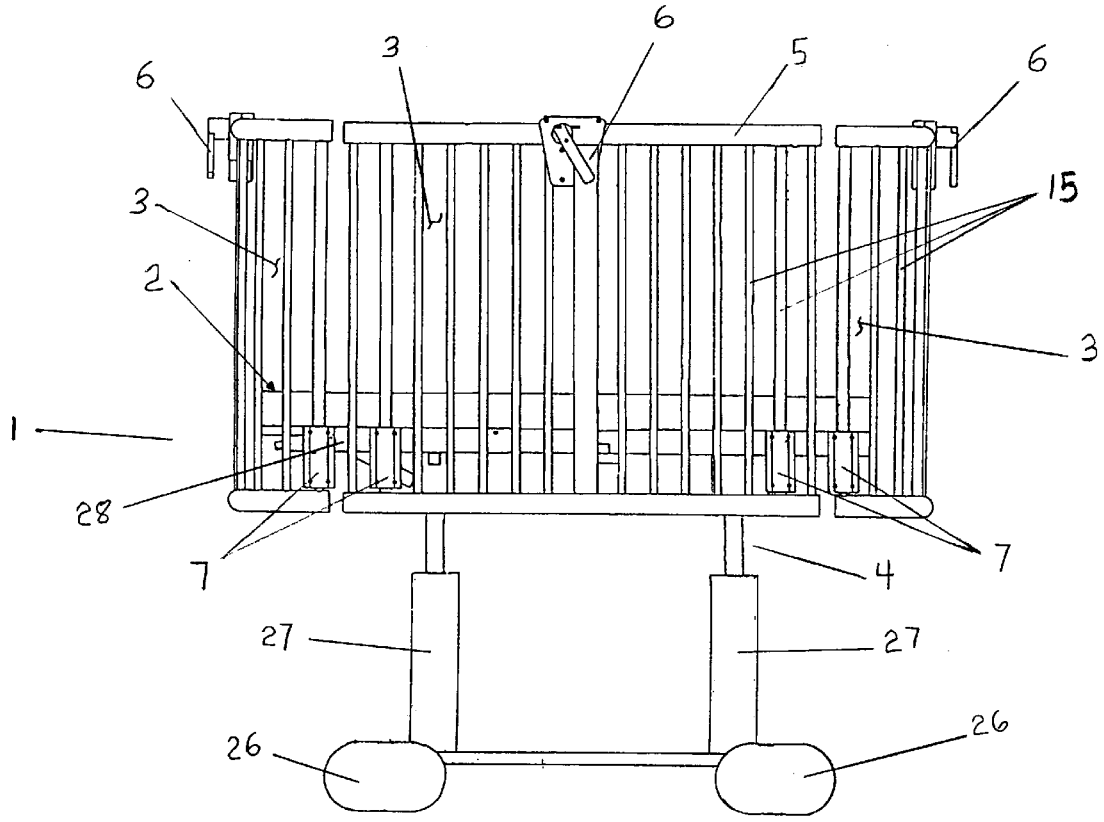
FIG. 1A is a side view of a crib apparatus according to the present invention in which the side rails are in uppermost positions.

A crib apparatus according to the present invention is shown in FIGS. 1A–2B. FIG. 1A shows a crib apparatus 1 of the present invention having side rails 3 enclosing a bed surface 2, and this figure shows the side rails 3 in the uppermost position. It is to be noted that the crib apparatus of FIGS. 1A and 1B may also have a single continuous side rail that encloses a bed surface. However, the following description will be made with reference to the crib apparatus having a plural number of discrete side rails which together enclose a bed surface. This is done for purposes of simplicity, and the details and operation provided are also applicable to a crib apparatus having a single side rail.

In the crib apparatus 1 shown in FIG. 1A, each of the side rails 3 is moveably connected to a frame 4, which supports the bed surface 2. The frame 4 includes components such as wheels 26, leg supports 27, and a bed support 28. Each of the side rails 3 has multiple spindles 15, and at least one of the spindles slides through a bearing block 7 which connects each of the side rails 3 to the frame 4. The bearing blocks 7 enable each of the side rails 3 to slide between an uppermost and a lowermost position. A positioning mechanism 6 is provided at each of the side rails 3 to allow its respective side rail to be positioned in a desired position.

Figure 1B:
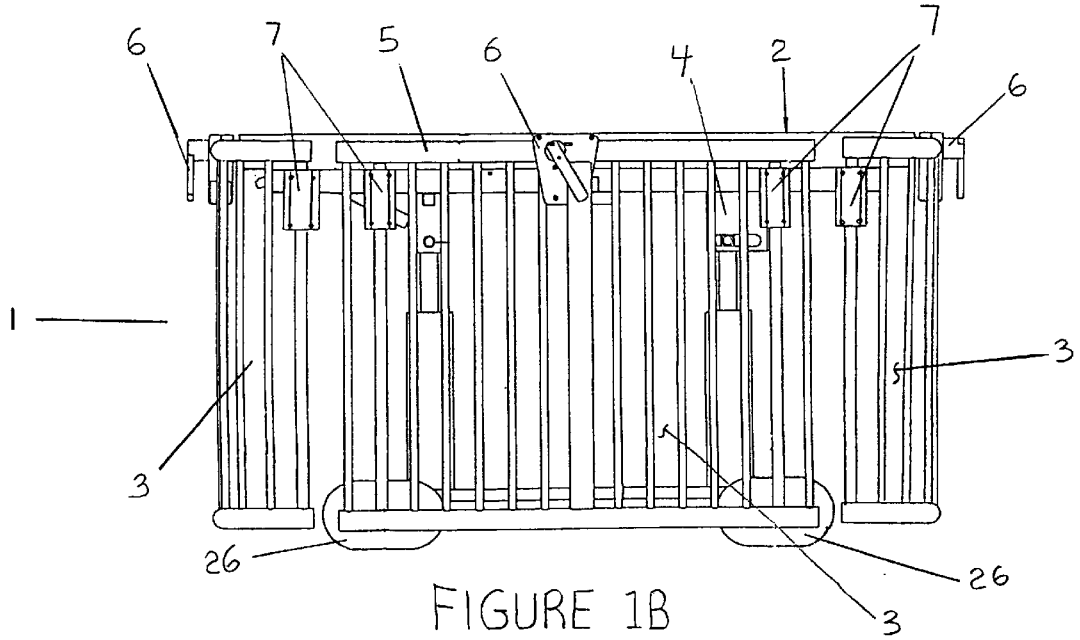
FIG. 1B is a side view of the crib apparatus according to the present invention in which the side rails are in lowermost positions.
Figure 1C:
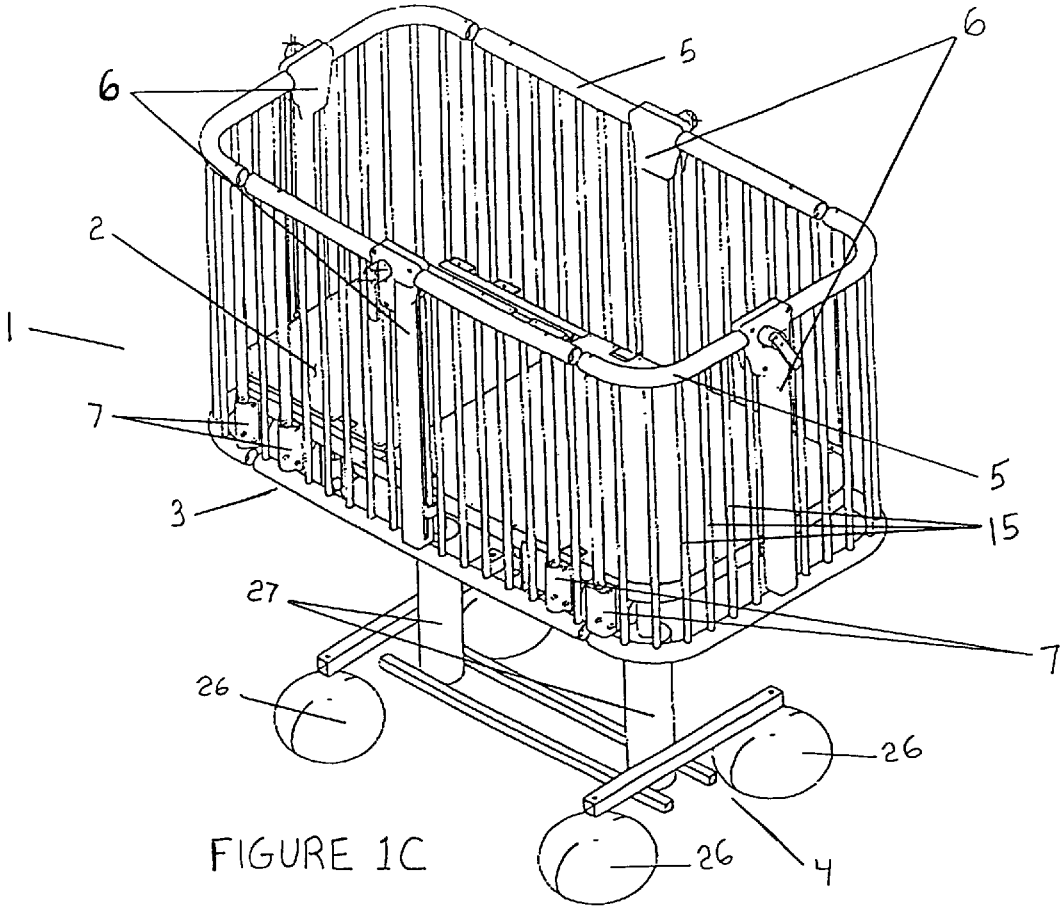
FIG. 1C is a perspective view providing another example of the crib apparatus shown in FIGS. 1A and 1B, and shows the side rails in uppermost positions.
Figure 1D:
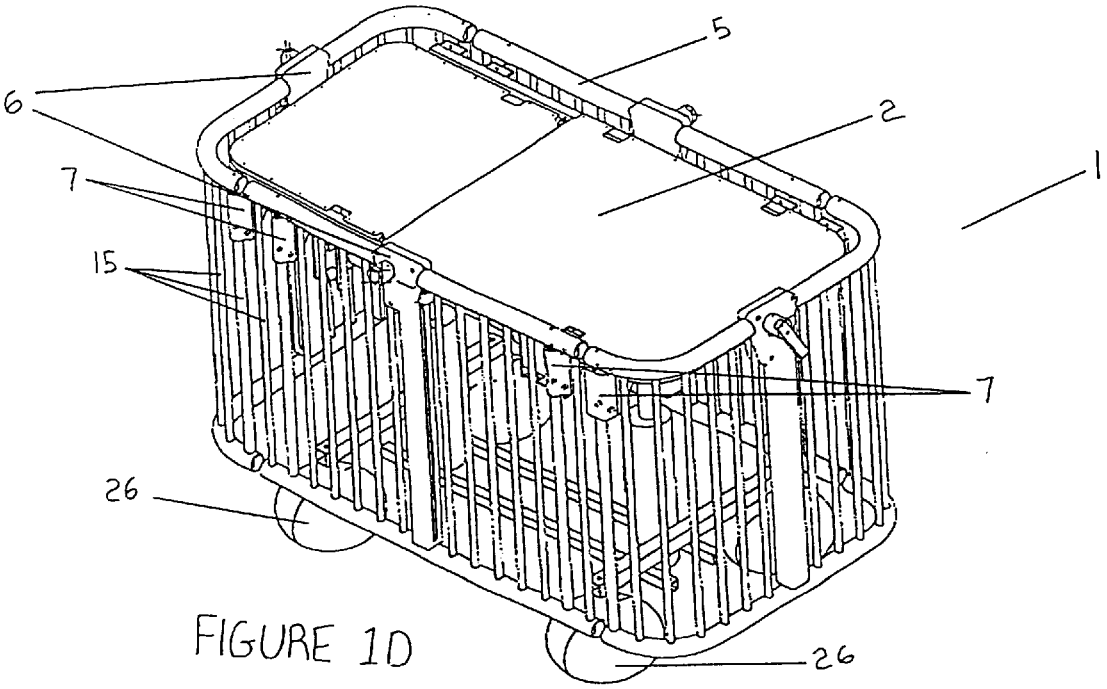
FIG. 1D is a perspective view of the crib apparatus of FIG. 1C, in which the side rails are in lowermost positions.

The crib apparatus 1 with all of the side rails 3 in the lowermost position is shown in FIG. 1B. When in the lowermost position, a top portion 5 of each of the respective side rails 3 is substantially at or below the bed surface 2. In other words, the top portion 5 of each of the side rails 3 does not extend substantially higher than the bed surface 2, so that the plane in which the bed surface lies is free of impediments. The term "free of impediments" as used herein means that the plane in which the bed surface lies may include some portions of the crib, provided that no portion extends a great enough distance above the bed surface so as to impede access to a child lying on the bed surface by an attendant. Similarly, the term "substantially at" as used herein means that the top portion of each of the side rails does not extend above the bed surface so as to impede access to a child lying on the bed surface. In other words, when all of the side rails are in the lowermost position, no portion of the crib (including the top portions of the side rails) extends above the bed surface more than a distance approximately equal to the front-to-back thickness of a typical child (or other patient). This is exemplified in FIGS. 1C and 1D. FIG. 1C provides an example of the crib apparatus of the present invention, in which the side rails are in the uppermost position, while FIG. 1D shows the same crib apparatus in which the side rails are in the lowermost position. However, the top portions of the side rails in FIG. 1D are substantially at the bed surface because they do not extend above the bed surface more than a distance approximately equal to the front-to-back thickness of a typical child (or patient). Consequently, an attending physician or nurse has unimpeded and full access to a child on the bed surface 2.

Figure 2A:
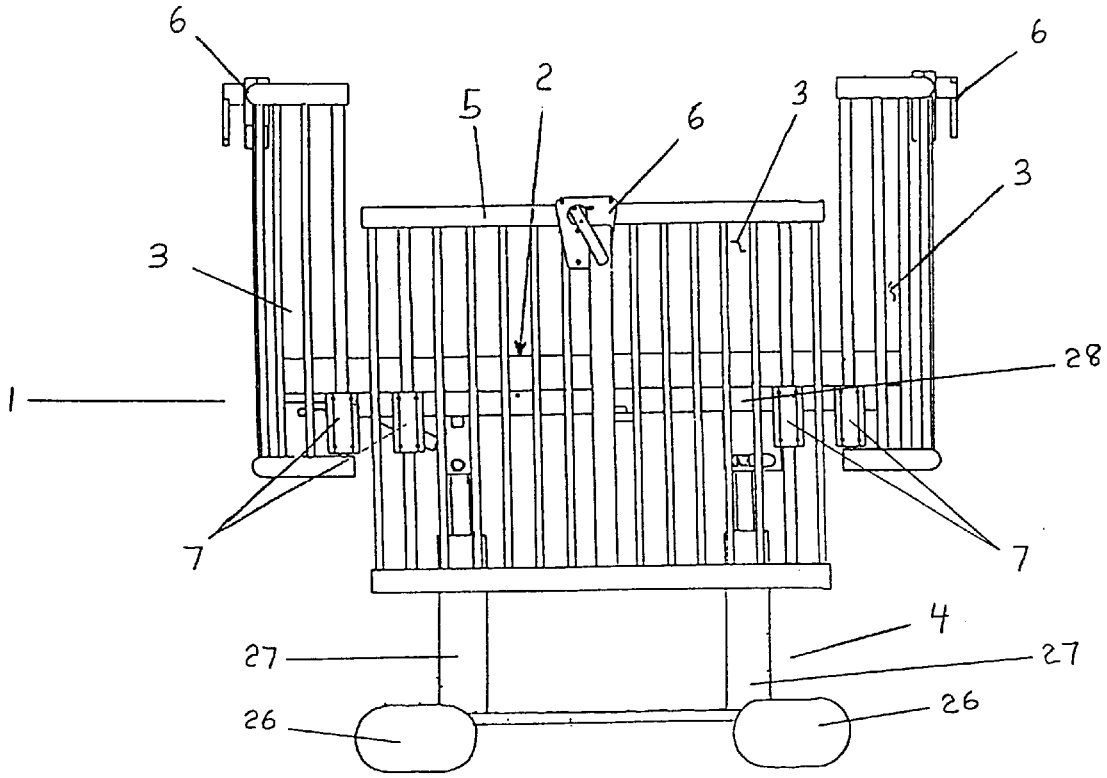
FIG. 2A is a side view of the crib apparatus according to the present invention showing the side rails at the ends of the bed surface in uppermost positions and the side rails at the sides of the bed surface in intermediate positions between the uppermost and the lowermost positions.
Figure 2B:
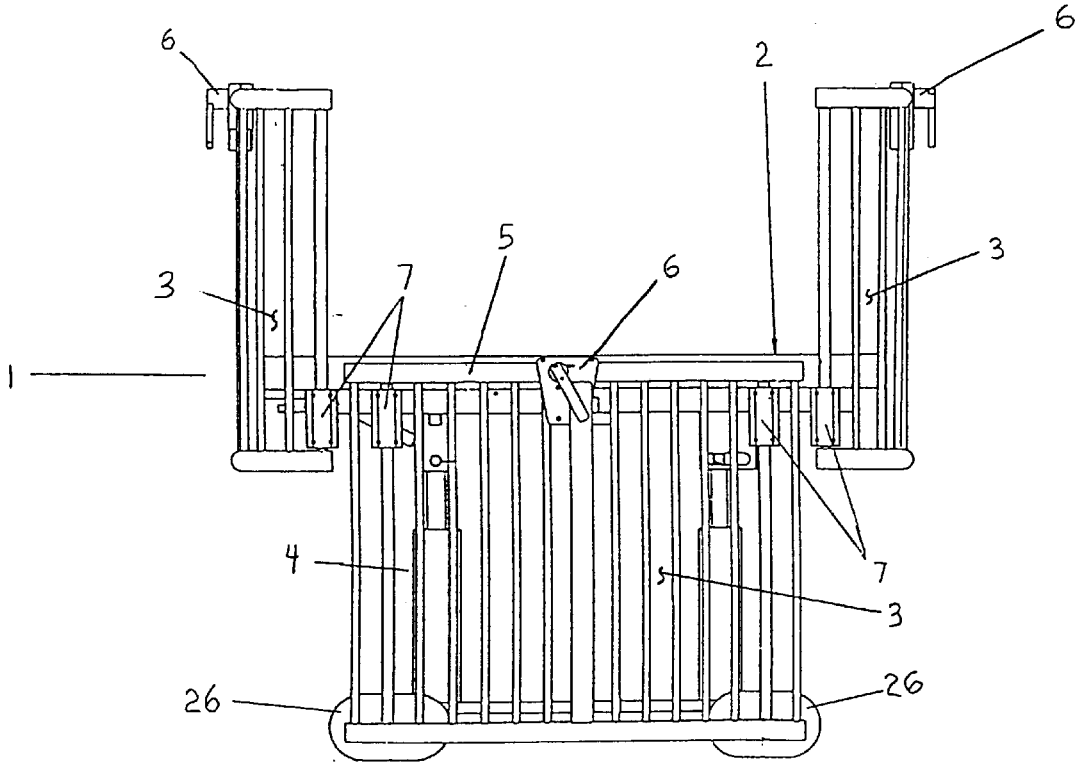
FIG. 2B is a side view similar to FIG. 2A showing the side rails at the ends of the bed surface in uppermost positions and the side rails at the sides of the bed surface in lowermost positions.

FIG. 2A shows the crib apparatus 1 of the present invention in which the side rails 3 along the sides of the bed surface 2 are in an intermediate position. The positioning mechanism 6 for each of the side rails 3 is capable of positioning its respective side rail 3 in at least one intermediate position (i.e., a position between the uppermost position and the lowermost position). FIG. 2B shows the crib apparatus 1 of the present invention in which the side rails 3 along the sides of the bed surface 2 are in lowermost positions, and the side rails 3 along the end of the bed surface 2 are in uppermost positions. The positioning mechanism 6 for each of the side rails 3 does not need to be linked to any of the other side rails or positioning mechanisms. Thus, each positioning mechanism allows its respective side rail to be positioned independent of the position of any of the other side rails.

Figure 3:
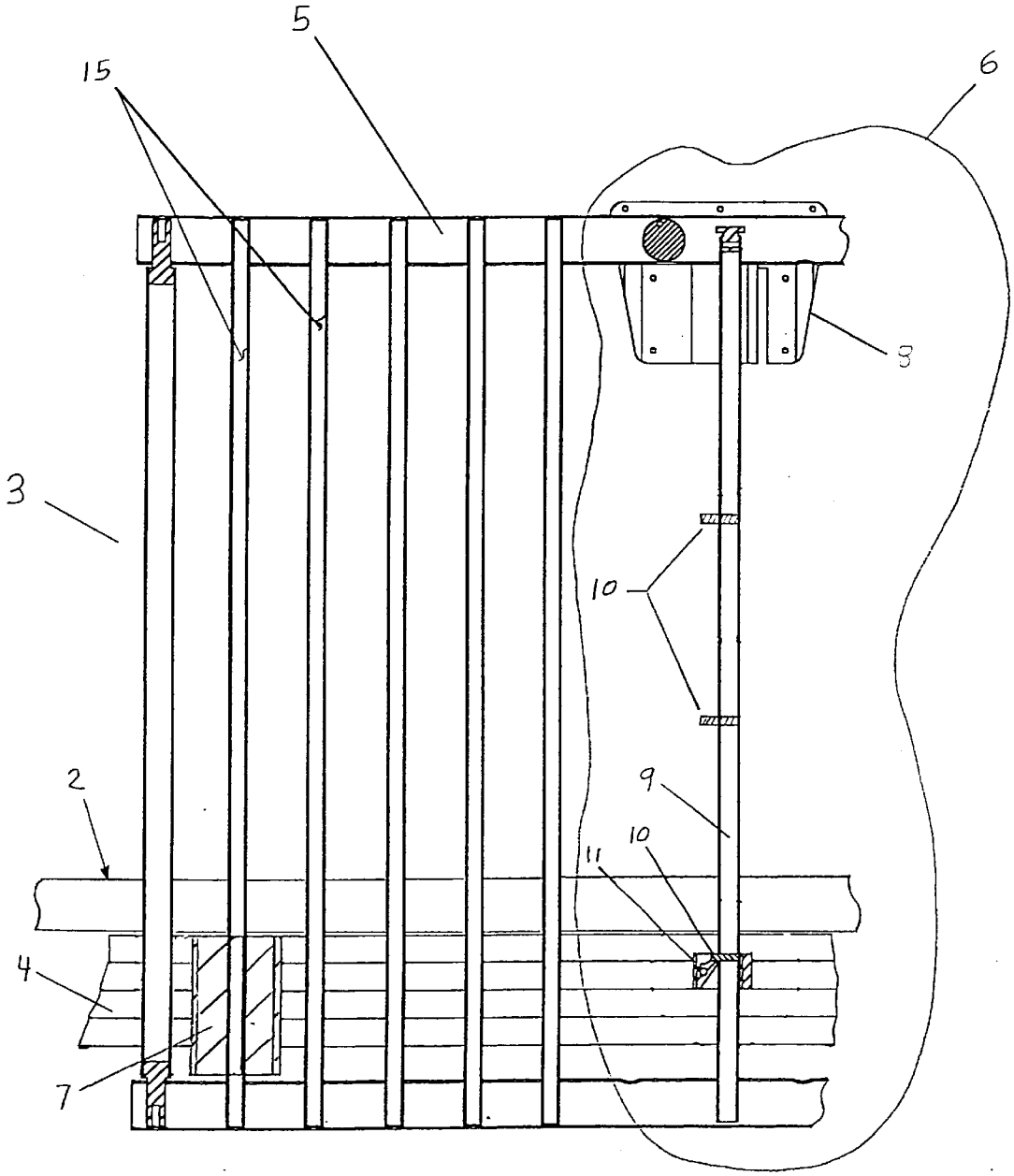
FIG. 3 is a detailed view of a side rail according to the present invention showing a positioning mechanism.

A detailed view of the positioning mechanism 6 for each of the side rails is provided in FIG. 3. As shown in this figure, each of the positioning mechanisms 6 comprises a handle component 8, a lock spindle 9 having a plural number of lock pins 10 rigidly fixed to it, and a locking component 11. The lock pins 10 are vertically spaced along the length of lock spindle 9, and extend therefrom in a radial direction. The handle component 8 is mounted to one of the side rails 3 at the top portion 5, and lock spindle 9 is rotatably connected to one of the side rails. The top portion and bottom portion of each side rail each include a plastic bushing, and cylindrical portions at the top and bottom ends of each lock spindle 9 are fitted within those bushings, respectively, so that the lock spindle 9 is able to rotate about its longitudinal axis within those bushings. The lock spindle 9 is slidably received within the locking component 11 so as to be able to slide through and rotate within the locking component 11. The locking component 11 is rigidly fixed to the frame 4 by a set of screws.

Figure 4:
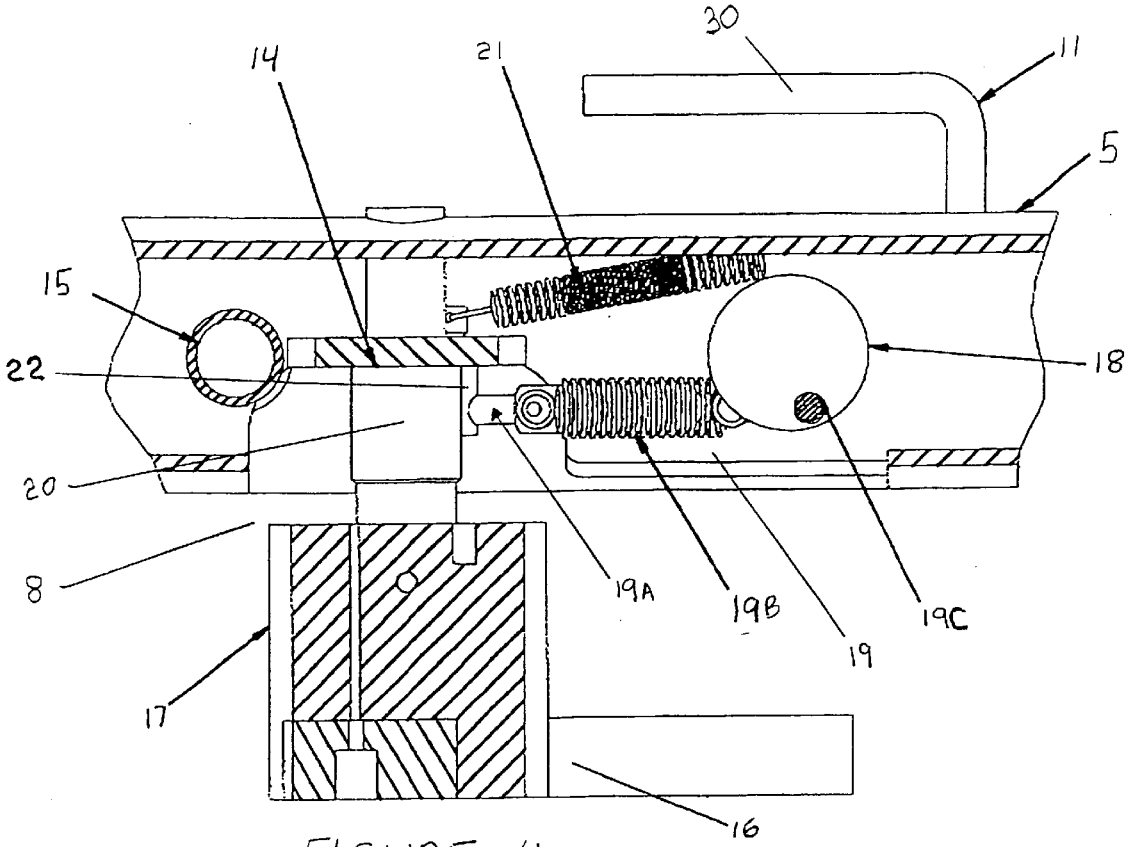
FIG. 4 is a top plan view of a section of a handle component of the present invention.

FIG. 4 provides a detailed top plan view of a section of the handle component 8. As shown in this view, a handle grip 16 extends radially from a handle boss 17, which forms a portion of handle axle 20. The handle component 8 is mounted to and supported by top portion 5 by handle axle 20, which extends through a pair of openings in top portion 5 so as to be able to rotate therein. Handle axle 20 includes a concentric flange 14 which is connected to a lock spindle cap 18 by a handle link 19. Handle link 19 includes a spindle rod 19C at a first end, and an axle rod 19A at a second end. The spindle rod 19C and axle rod 19A are connected by handle link spring 19B. Axle rod 19A is pinned to an outer portion of flange 14 by connector 22 so as to be able to pivot about an axis of connector 22, and connector 22 pivots relative to flange 14. The handle axle 20 is also connected to an inner surface of the side rail top portion 5 by a return spring 21. Both the handle spring 19B and the return spring 21 are in tension.

Figure 5:
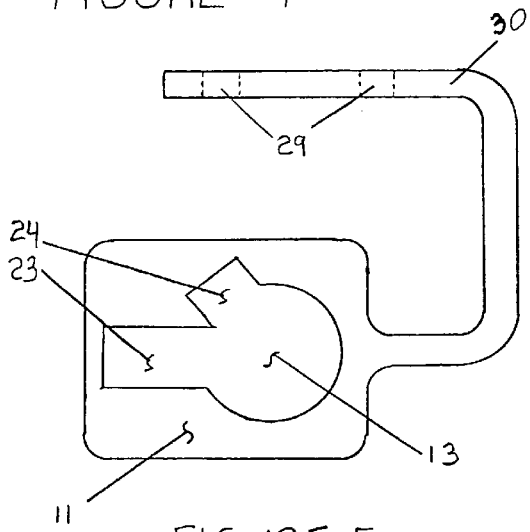
FIG. 5 is a top plan view of a locking component of the present invention, without a catch.

The locking component 11 is positioned below the handle component 8 and, therefore, is partially obscured in FIG. 4. However, FIG. 5 provides a top plan view of locking component 11. As shown in this figure, locking component 11 has a mounting arm 30, which includes several screw holes 29. The locking component 11 is fixed to frame 4 by screws which connect mounting arm 30 to frame 4. A through-hole 13 extends the entire length (or, as viewed from the side, the height) of locking component 11. A pair of grooves, including catch groove 23 and clearance groove 24, extend the length of the locking component 11 along the through-hole 13. In operation, lock spindle 9 slides through the through-hole 13 in locking component 11 while one of the lock pins 10 slides through either the catch groove 23 (when sliding in the upward direction) or the clearance groove 24 (when sliding in the downward direction). This operation will be explained in greater detail below with respect to FIGS. 6A through 8B.

Figure 6A:
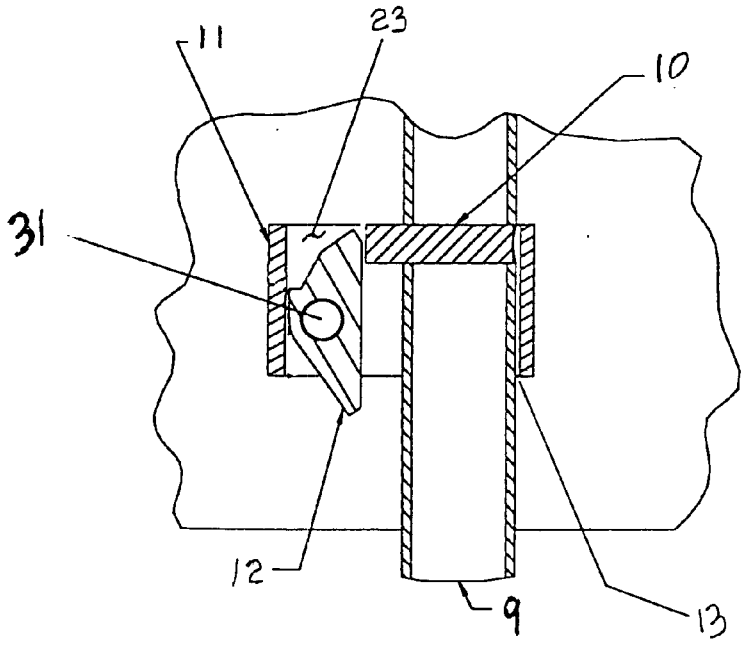
FIG. 6A is a side view of the locking component, showing a catch in an open position.
Figure 6B:
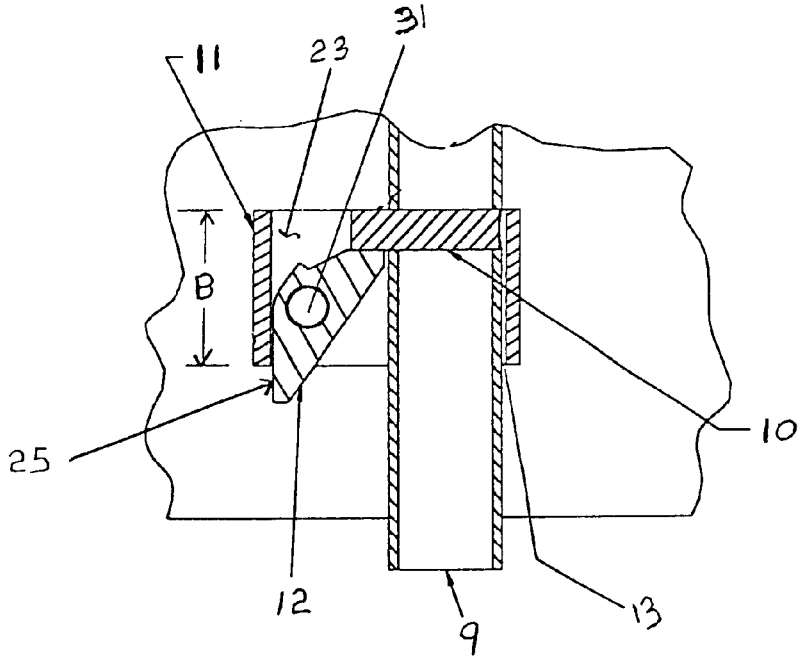
FIG. 6B is a side view similar to FIG. 6A, but showing the catch in a closed, or normal, position.

FIGS. 6A and 6B show catch groove 23 in the locking component 11, which has a catch 12 pivotally mounted therein by pivot pin 31. As explained above, locking component 11 is fixed to frame 4, while the lock spindle 9 having lock pins 10 fixed thereon is connected to one of the moveable side rails 3. As shown in FIG. 6A, as the side rail 3 (and, thus, lock spindle 9) is raised, the catch 12 is pushed up and caused to pivot about pivot pin 31 into an open position as the lock pin 10 slides through the catch groove 23 in the upward direction. Referring now to FIG. 6B, as the lock pin 10 clears the catch 12, the catch 12 is returned to its normal position by, for example, gravity. The lock pin 10 is then slightly lowered and comes to rest on the catch 12 because the catch 12 cannot pivot downward past its normal position (shown in FIG. 6B) due to stopping surface 25 which contacts a surface of locking component 11. Consequently, each of the side rails 3 can be raised and positioned at several intermediate positions, corresponding to the number of lock pins 10 spaced along lock spindle 9 as shown in FIG. 3.

Figure 7A:
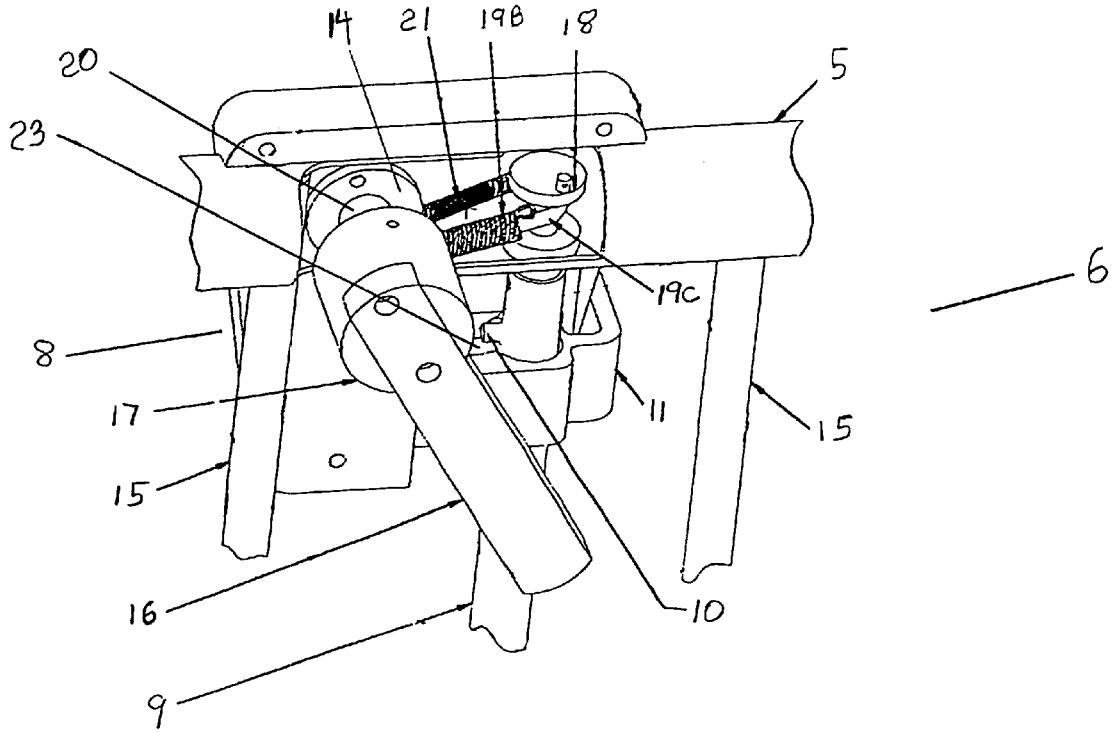
FIG. 7A is a perspective view of a portion of the positioning mechanism of the present invention, showing the positioning mechanism in a normal state.

The operation of the handle component 8 will now be explained with reference to FIGS. 7A–8B. FIG. 7A shows the handle component 8, including handle grip 16, in a normal state. In the normal state, the lock pin 10 on the lock spindle 9 is aligned with the catch groove 23. Therefore, when in the normal state, the side rail 3 can be raised into one of the positions as explained above with reference to FIGS. 6A and 6B. However, to lower each of the side rails 3, the lock pin 10 must be rotated over to the clearance groove 24 in the locking component 11. The clearance groove 24 does not have a catch 12 mounted inside, so the pin 10 is able to slide downward through clearance groove 24 without obstruction.

Figure 7B:
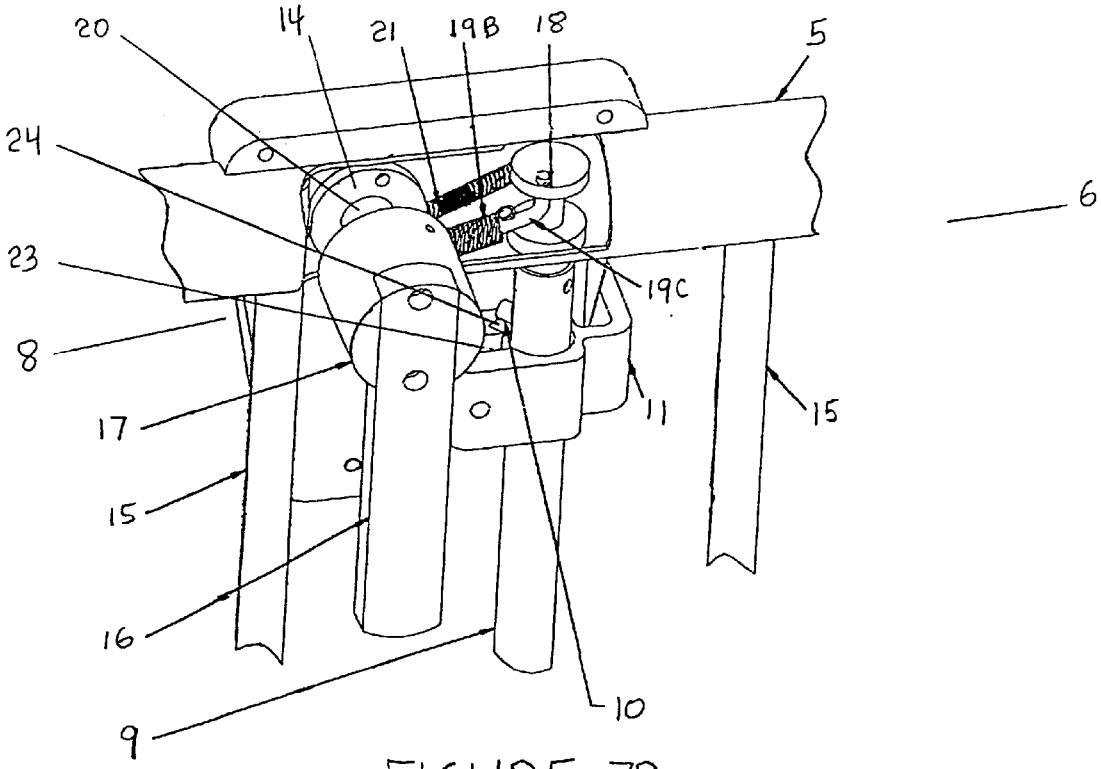
FIG. 7B is a perspective view similar to FIG. 7A, but showing the positioning mechanism in an actuated state.
Figure 8A:
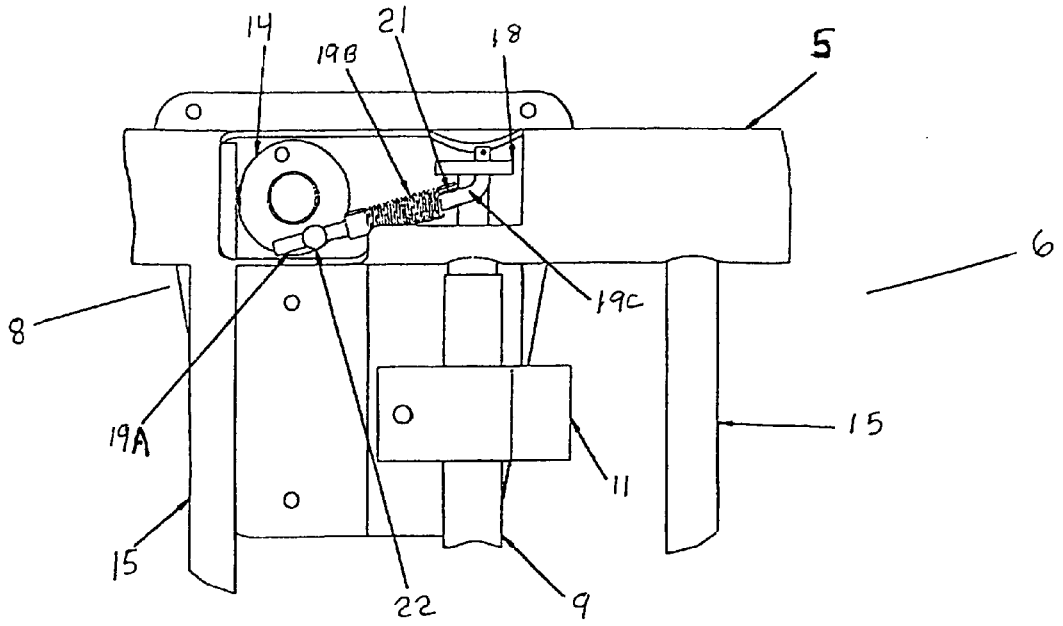
FIG. 8A is a side view of a portion of the positioning mechanism in the normal state with the handle removed.
Figure 8B:
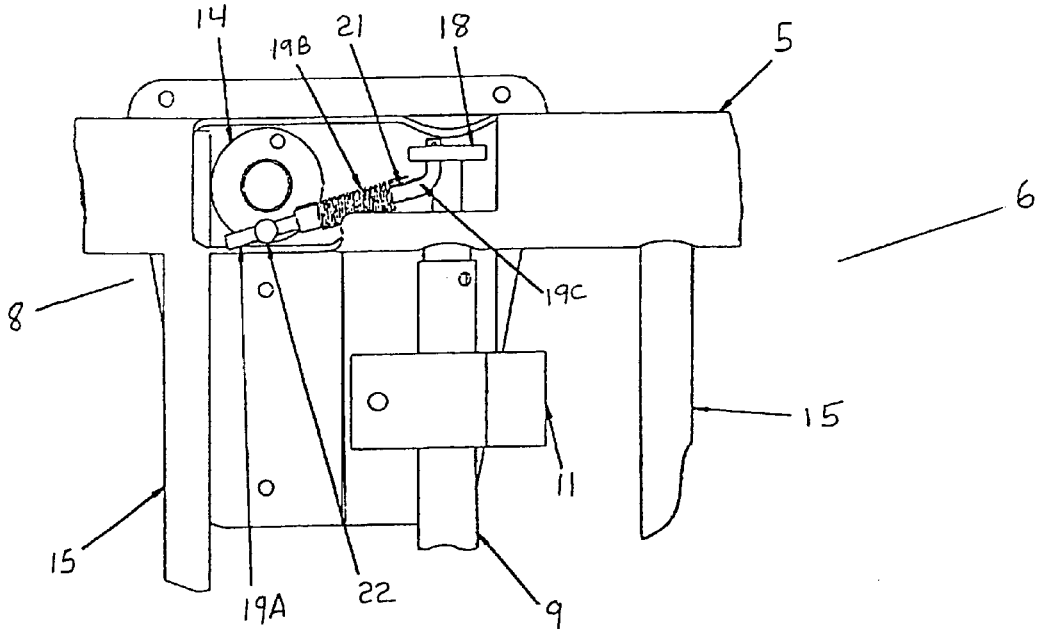
FIG. 8B is a side view similar to FIG. 8A, but showing the positioning mechanism in the actuated state.
Figure 9:
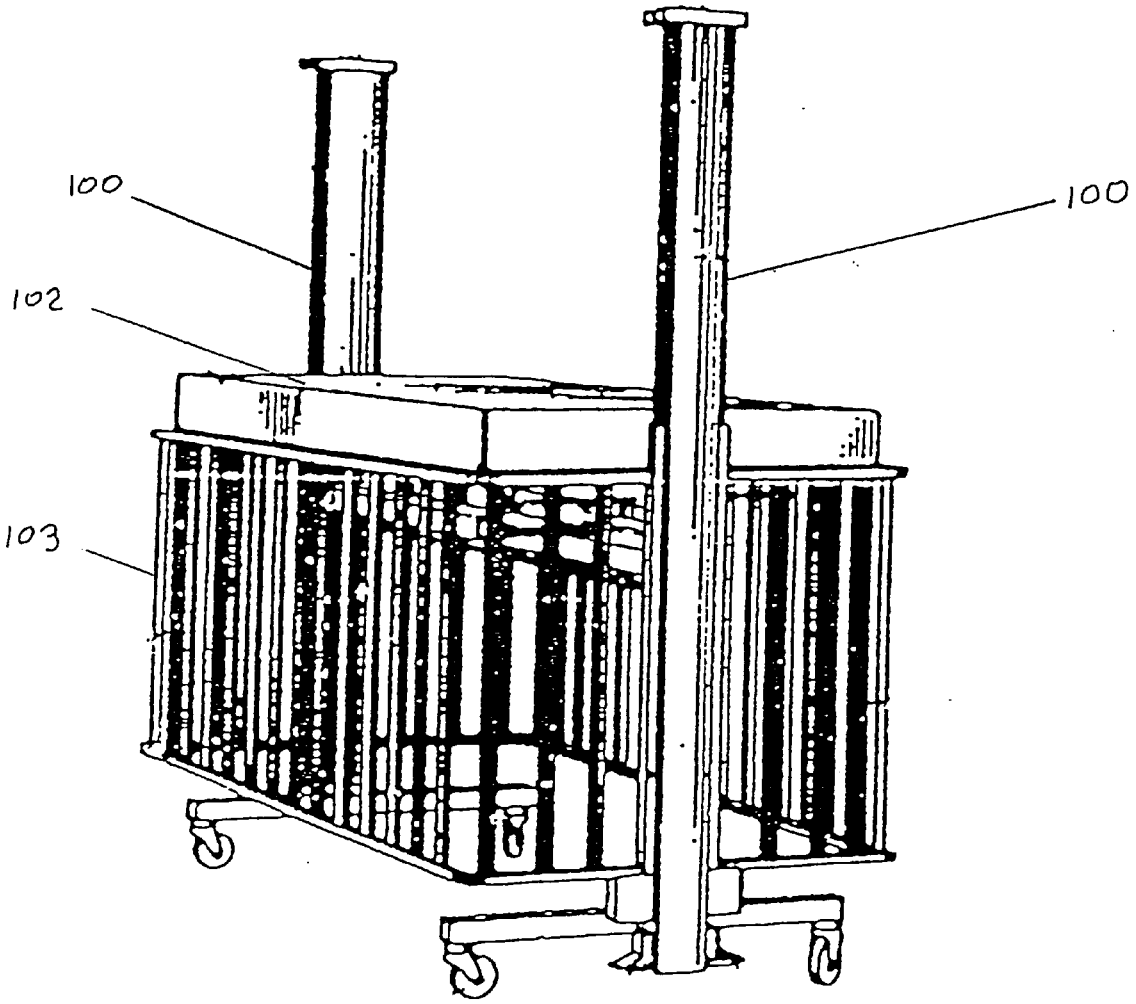
FIG. 9 is a perspective view showing a conventional crib apparatus.

In order to rotate lock pin 10 so as to align it with clearance groove 24, the handle grip 16 of the handle component 8 must be rotated clockwise to the actuation state as shown in FIG. 7B. FIGS. 8A and 8B correspond to FIGS. 7A and 7B, respectively, but clearly show the position of handle link 19 and handle link connector 22 because the handle boss 17 and handle grip 16 have been removed in these views for purposes of clarity. Handle link connector 22 pins axle rod 19A of handle link 19 to flange 14, as explained with reference to FIG. 4. As the handle is rotated clockwise from the normal state shown in FIG. 8A to the actuation state shown in FIG. 8B, handle link connector 22 pulls the handle link 19. As explained with respect to FIG. 4 and also shown in FIGS. 7A and 7B, spindle rod 19*c* is connected to an outer portion of lock spindle cap 18 by being inserted into a hole in lock spindle cap 18 (and retained by, for example, a cotter pin). Lock spindle cap 18 forms the upper portion of lock spindle 9. Consequently, when handle link 19 is pulled, it causes lock spindle 9 to rotate about its longitudinal axis, thereby rotating lock pin 10 so that it can align with clearance groove 24. When the lock pin 10 is aligned with clearance groove 24, the side rail 3 can be lowered since the lock pin 10 can easily slide downward through clearance groove 24. Once the lock pin 10 passes through the clearance groove 24 in the locking component 11, return spring 21 will cause the handle to return to the normal state shown in FIGS. 7A and 8A unless the handle is held in the actuation state.

Referring again to FIGS. 6A and 6B, catch 12 is mounted by pivot pin 31 within catch groove 23 at a midpoint in the length B of the through-hole 13 (i.e., a longitudinal midpoint of the through-hole). Therefore, as shown in FIG. 6B, when the lock pin 10 comes to rest on the catch 12, the lock pin 10 is sitting within the catch groove 23. Consequently, the handle component 8 cannot rotate the lock spindle 9 so as to align the lock pin 10 with clearance groove 24 unless the side rail 3 is raised slightly to lift the lock pin 10 out of the catch groove 23. Thus, two actions—raising the side rail slightly and actuating the handle—are necessary in order to lower the side rails. This is an important feature to prevent the accidental lowering of one of the side rails.

With reference to FIGS. 7A through 8B, handle spring 19B connects axle rod 19A to spindle rod 19C so as to form handle link 19. Handle spring 19B enables an operator, such as an attending physician or nurse, to complete the two actions necessary for lowering each side rail in any order. That is, the side rail 3 can be raised to lift the lock pin 10 out of catch groove 23 and then the handle grip 16 can be turned to rotate the lock spindle 9 and align the lock pin 10 with the clearance groove 24, or the handle grip 16 can first be turned while pin 10 is still in catch groove 23 (thus stretching handle spring 19B), and then the side rail can be raised slightly to lift the lock pin 10 out of catch groove 23. It should be noted that if the handle is actuated before raising the side rail, the lock pin 10 will immediately be aligned with the clearance groove 24 upon being lifted out of the catch groove 23 due to the force of tensioned handle spring 19B. As can be seen from this description, the positioning mechanism of the present invention can be actuated with one hand and, therefore, an attending physician or nurse has the other hand free to complete other necessary actions.

The crib apparatus of the present invention has been described for the purpose of illustrating a particular embodiment. However, it is recognized that various changes, modifications, and additions may be made to the illustrated embodiment without departing from the spirit and scope of the present invention.

We claim:

1. An apparatus comprising:

a frame;

a bed surface supported by said frame and having a periphery;

at least one side rail movably connected to said frame along said periphery of said bed surface for enclosing said bed surface, each of said at least one side rail having a top portion; and at least one side rail positioning mechanism, each of said at least one positioning mechanism being coupled to a respective one of said at least one side rail, each of said at least one positioning mechanism being operable to position said respective one of said at least one side rail in an uppermost position whereat said top portion of said respective one of said at least one side rail is above said bed surface, and in a lowermost position whereat said top portion of said respective one of said at least one side rail is substantially at or below said bed surface;

wherein each of said at least one side rail is movably connected to said frame such that when every one of said at least one side rail is simultaneously in said lowermost position, a plane including said bed surface is free of impediments thereby allowing unimpeded access to a patient on said bed surface about an entirety of said periphery of said bed surface.

2. The apparatus of claim 1, wherein said at least one side rail comprises a plurality of side rails, and said at least one side rail positioning mechanism comprises a plurality of side rail positioning mechanisms, each of said positioning mechanisms being coupled to a respective one of said side rails and being operable to position said respective one of said side rails independent of a position of a remaining group of said side rails.

3. The apparatus of claim 1, further comprising a plurality of bearing blocks fixed to said frame, wherein each of said at least one side rail is slidably connected to said frame by said bearing blocks such that each of said at least one side rail is capable of sliding between said uppermost position and said lowermost position.

4. The apparatus of claim 1, wherein each of said at least one positioning mechanism is operable to position said respective one of said at least one side rail in at least one intermediate position between said uppermost position and said lowermost position.

5. The apparatus of claim 1, wherein when said at least one side rail is in said lowermost position, said top portion of said at least one side rail is in a plane including said bed surface.

6. The apparatus of claim 1, wherein each of said at least one positioning mechanism comprises:

(A) a handle component mounted to said respective one of said at least one side rail;

(B) a vertical lock spindle rotatably attached to said respective one of said at least one side rail and having a plurality of lock pins spaced vertically thereon, said lock spindle being operable to rotate between a lock position and a release position; and (C) a locking component slidably receiving said vertical lock spindle, said locking component being fixed to said frame;

wherein said handle component is connected to said lock spindle such that said handle component is operable to rotate said lock spindle from said lock position to said release position, thereby allowing one of said plurality of lock pins to be released from said locking component.

7. The apparatus of claim 6, wherein said locking component includes a catch to allow upward vertical movement of one of said plurality of lock pins through said locking component while preventing downward vertical movement of said one of said plurality of lock pins through said locking component.

8. The apparatus of claim 7, wherein said locking component includes a through-hole slidably receiving said lock spindle, and a pair of vertical grooves extending along said through-hole in a longitudinal direction, said catch being pivotally mounted within one of said grooves.

9. The apparatus of claim 8, wherein said catch is pivotally mounted within one of said grooves at a longitudinal midpoint of said through-hole such that when one of said lock pins is resting on said catch, said one of said lock pins is located within said one of said grooves.

10. An apparatus comprising:

a frame;

a bed surface supported by said frame and having a periphery;

at least one side rail movably connected to said frame along said periphery of said bed surface for enclosing said bed surface, each of said at least one side rail having a top portion; and at least one side rail positioning mechanism, each of said at least one positioning mechanism being coupled to a respective one of said at least one side rail, each of said at least one positioning mechanism including:

(A) a handle component mounted to said respective one of said at least one side rail;

(B) a vertical lock spindle rotatably attached to said respective one of said at least one side rail and having a plurality of lock pins spaced vertically thereon, said lock spindle being operable to rotate between a lock position and a release position; and (C) a locking component slidably receiving said vertical lock spindle, said locking component being fixed to said frame;

wherein said handle component is connected to said lock spindle such that said handle component is operable to rotate said lock spindle from said lock position to said release position, thereby allowing one of said plurality of lock pins to be released from said locking component, each of said positioning mechanisms being operable to position said respective one of said at least one side rail in an uppermost position whereat said top portion of said respective side rail is above said bed surface, and in a lowermost position whereat said top portion of said respective side rail is substantially at or below said bed surface.

11. The apparatus of claim 10, wherein said at least one side rail comprises a plurality of side rails, and said at least one side rail positioning mechanism comprises a plurality of side rail positioning mechanisms, each of said positioning mechanisms being coupled to a respective one of said side rails and being operable to position said respective one of said side rails independent of a position of a remaining group of said side rails.

12. The apparatus of claim 10, further comprising a plurality of bearing blocks fixed to said frame, wherein each of said at least one side rail is slidably connected to said frame by said bearing blocks such that each of said at least one side rail is capable of sliding between said uppermost position and said lowermost position.

13. The apparatus of claim 10, wherein each of said at least one positioning mechanism is operable to position said respective one of said at least one side rail in at least one intermediate position between said uppermost position and said lowermost position.

14. The apparatus of claim 10, wherein when said at least one side rail is in said lowermost position, said top portion of said at least one side rail is in a plane including said bed surface.

15. The apparatus of claim 10, wherein said locking component includes a catch to allow upward vertical movement of one of said plurality of lock pins through said locking component while preventing downward vertical movement of said one of said plurality of lock pins through said locking component.

16. The apparatus of claim 15, wherein said locking component includes a through-hole for slidably receiving said lock spindle, and a pair of vertical grooves extending along along said through-hole in a longitudinal direction, said catch being pivotally mounted within one of said grooves.

17. The apparatus of claim 16, wherein said catch is pivotally mounted within one of said grooves at a longitudinal midpoint of said through-hole such that when one of said lock pins is resting on said catch, said one of said lock pins is located within said one of said grooves.

18. An apparatus comprising:

a side rail; and a side rail positioning mechanism for positioning said side rail, including:

(A) a handle component mounted to said side rail;

(B) a vertical lock spindle rotatably attached to said side rail and having a plurality of lock pins spaced vertically thereon, said lock spindle being operable to rotate between a lock position and a release position; and (C) a locking component for holding said lock spindle in position, said locking component slidably receiving said vertical lock spindle;

wherein said handle component is connected to said lock spindle such that said handle component is operable to rotate said lock spindle from said lock position to said release position, thereby allowing one of said plurality of lock pins to be released from said locking component.

19. The apparatus of claim 18, wherein said locking component includes a catch to allow upward vertical movement of one of said plurality of lock pins through said locking component while preventing downward vertical movement of said one of said plurality of lock pins through said locking component.

20. The apparatus of claim 19, wherein said locking component includes a through-hole for slidably receiving said lock spindle, and a pair of vertical grooves extending along said through-hole in a longitudinal direction, said catch being pivotally mounted within one of said grooves.

21. The apparatus of claim 20, wherein said catch is pivotally mounted within one of said grooves at a longitudinal midpoint of said through-hole such that when one of said lock pins is resting on said catch, said one of said lock pins is located within said one of said grooves.

22. An apparatus comprising:

a frame;

a bed surface supported by said frame and having a periphery;

at least one side rail movably connected to said frame along said periphery of said bed surface, each of said at least one side rail having a top portion;

at least one side rail positioning mechanism, each of said at least one side rail positioning mechanism being coupled to a respective one of said at least one side rail, each of said at least one positioning mechanism including:

(A) a handle component mounted to said respective one of said at least one side rail, said handle component including an axle, a grip radially extending from an end of said axle, and a link having a first end and a second end, said second end being connected to said axle;

(B) a vertical lock spindle rotatably attached to said respective one of said at least one side rail and having a plurality of lock pins spaced vertically thereon, each of said lock pins radially extending from said lock spindle, said first end of said link being connected to said lock spindle; and (C) a locking component slidably receiving said lock spindle, said locking component being fixed to said frame.

23. The apparatus of claim 22, wherein said locking component includes a catch pivotally mounted therein.

24. The apparatus of claim 23, wherein said locking component includes a through-hole slidably receiving said lock spindle, and a pair of vertical grooves extending along said through-hole in a longitudinal direction, said catch being pivotally mounted within one of said grooves.

25. The apparatus of claim 24, wherein said catch is pivotally mounted within one of said grooves at a longitudinal midpoint of said through-hole.

26. The apparatus of claim 22, wherein said link comprises a first rod and a second rod connected by a spring.

27. The apparatus of claim 26, wherein said axle includes a concentric flange, and wherein said second rod is located at said second end of said link and is pivotally connected to said flange.

28. The apparatus of claim 27, wherein said first rod is located at said first end of sad link and is pivotally connected to said lock spindle.

29. The apparatus of claim 22, wherein said axle includes a concentric flange, said second end of said link being pivotally connected to said flange.

* * * * *